US008992257B2

(12) United States Patent
Ii

(10) Patent No.: US 8,992,257 B2
(45) Date of Patent: Mar. 31, 2015

(54) SHIELDED CONNECTOR

(71) Applicant: Yazaki Corporation, Tokyo (JP)

(72) Inventor: Ryosuke Ii, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 97 days.

(21) Appl. No.: 13/870,459

(22) Filed: Apr. 25, 2013

(65) Prior Publication Data

US 2013/0288522 A1 Oct. 31, 2013

(30) Foreign Application Priority Data

Apr. 26, 2012 (JP) ..... 2012-101731

(51) Int. Cl.

| | |
|---|---|
| ***H01R 13/648*** | (2006.01) |
| ***H01R 13/59*** | (2006.01) |
| ***H01R 9/03*** | (2006.01) |
| ***H01R 13/422*** | (2006.01) |
| *H01R 13/6581* | (2011.01) |

(52) U.S. Cl.

CPC ..... *H01R 13/59* (2013.01); *H01R 9/038* (2013.01); *H01R 13/4223* (2013.01); *H01R 13/6581* (2013.01)

USPC ..... 439/607.41

(58) Field of Classification Search

USPC ..... 439/607.41–607.52

See application file for complete search history.

(56) References Cited

U.S. PATENT DOCUMENTS

| | | | | |
|---|---|---|---|---|
| 5,961,351 | A * | 10/1999 | Wu | 439/607.45 |
| 6,039,606 | A * | 3/2000 | Chiou | 439/607.45 |
| 6,814,615 | B2 * | 11/2004 | Laub et al. | 439/585 |
| 6,878,011 | B2 * | 4/2005 | Laub et al. | 439/585 |
| 7,677,936 | B2 * | 3/2010 | Sato et al. | 439/892 |
| 7,695,318 | B1 * | 4/2010 | Wang et al. | 439/607.01 |
| 7,896,559 | B2 * | 3/2011 | Yi et al. | 385/75 |
| 8,011,968 | B2 * | 9/2011 | Lai et al. | 439/660 |
| 8,038,475 | B2 * | 10/2011 | Kameyama et al. | 439/607.51 |
| 8,764,486 | B2 * | 7/2014 | Ii | 439/607.46 |
| 8,834,201 | B2 * | 9/2014 | Miyawaki et al. | 439/585 |

(Continued)

FOREIGN PATENT DOCUMENTS

| | | |
|---|---|---|
| CN | 2271037 Y | 12/1997 |
| CN | 201498836 U | 6/2010 |

(Continued)

OTHER PUBLICATIONS

Chinese Office Action and Search Report for the related Chinese Patent Application No. 201310150322X dated Jan. 6, 2015.

*Primary Examiner* — Ross Gushi
(74) *Attorney, Agent, or Firm* — Kenealy Vaidya LLP

(57) ABSTRACT

A shielded connector includes: an inner housing including terminal accommodation chambers into which terminals crimped to shielded-wire ends of a shielded electric wire are inserted; and a shield shell including a shield part covering the inner housing and a barrel part crimping and fixing a sheath part of the shielded electric wire. Each of the terminal accommodation chambers has a space opened in a first direction at one side thereof and opened in a second direction orthogonal to the first direction at front and rear sides thereof. A partition wall partitioning the space includes: an engaging part restraining one of the terminals, which is inserted into the space from the one side, from moving in the second direction; and a temporary engaging part preventing the one of the terminals, which is inserted into the space from the one side, from separating from the space.

4 Claims, 10 Drawing Sheets

(56) References Cited

U.S. PATENT DOCUMENTS

| | | | | |
|---|---|---|---|---|
| 8,840,435 | B2 * | 9/2014 | Plazio et al. | 439/701 |
| 2003/0060084 | A1 * | 3/2003 | Aoki | 439/610 |
| 2003/0104723 | A1 | 6/2003 | Laub et al. | |
| 2007/0270036 | A1 * | 11/2007 | Belopolsky et al. | 439/610 |
| 2009/0068904 | A1 | 3/2009 | Sato et al. | |
| 2011/0034080 | A1 * | 2/2011 | Su et al. | 439/607.01 |
| 2012/0322307 | A1 | 12/2012 | Kudo | |
| 2013/0023154 | A1 * | 1/2013 | Ii | 439/607.5 |
| 2013/0023155 | A1 * | 1/2013 | Ii | 439/607.27 |
| 2013/0052866 | A1 * | 2/2013 | Ii | 439/607.41 |
| 2013/0288522 | A1 * | 10/2013 | Ii | 439/607.01 |
| 2013/0288523 | A1 * | 10/2013 | Ii | 439/607.01 |

FOREIGN PATENT DOCUMENTS

| | | | |
|---|---|---|---|
| CN | 102832510 | A | 12/2012 |
| JP | 2002-319458 | A | 10/2002 |
| JP | 2003-173828 | A | 6/2003 |

* cited by examiner

SHIELDED CONNECTOR

CROSS-REFERENCE TO RELATED APPLICATION(S)

This application is based upon and claims the benefit of priority from prior Japanese patent application No. 2012-101731, filed on Apr. 26, 2012, the entire contents of which are incorporated herein by reference.

BACKGROUND

The presently disclosed subject matter relates to a shielded connector.

There is a shielded connector which is connected to a multiconductor shielded cable having a plurality of signal lines each of which includes a conductor including a plurality of twisted wires and an insulated sheath layer covering the conductor (for example, refer to JP-A-2003-173828).

A shielded connector 501 of a cable-side is shown in FIG. 10.

A shielded cable (shielded electric wire) 510 includes signal lines 511, each of which includes a conductor 511*a* including a plurality of twisted wires and an insulated sheath layer 511*b* covering the conductor 511*a*, a drain line 512 including a plurality of twisted copper wires, a metal foil 503 covering the signal lines 511 and the drain line 512, and an insulated sheath (sheath part) 514 covering an outer periphery of the metal foil 503.

In the shielded connector 501, the signal lines 511 and the drain line 512 are exposed at an end part of the shielded cable 510, the exposed end parts are respectively connected to terminals 520, the terminals 520 are accommodated in terminal accommodation parts 531 of a dielectric member (inner housing) 530, and a metallic outer conductor shell 540, which is electrically connected to the central terminal 520 connected to the drain line 512, is mounted onto the dielectric member 530.

As shown in FIG. 11, as a shielded electric wire such as USB 2.0 (differential connector for high-speed transmission), a special shielded electric wire 603 is used so as to satisfy transmission performance and noise-resistance performance. Since the shielded electric wire 603 has a stand-alone structure satisfying the performance, a sheath 629 comprised of an insulated sheath 615 and a shield foil 627 of the shielded electric wire 603 is required to be stripped at a connection part 625 to be connected to terminals 605. Therefore, the part whose sheath 629 is stripped causes an impedance mismatch to thus deteriorate the transmission performance. Hence, a length of the sheath 629 that is stripped is preferable as short as possible.

However, if the length of the sheath 629 of the shielded electric wire 603 to be stripped is shortened, when terminal-mounted shielded electric wires 607 in which the terminals 605 are crimped to the shielded electric wire 603 are inserted into an inner housing 609, all (four, for the USB 2.0) the terminal-mounted shielded electric wires 607 are simultaneously inserted with the terminals 605 being oriented or a semi-insertion state is intentionally made to align the terminal-mounted shielded electric wires 607. The simultaneous insertion operation or alignment operation of the semi-insertion state lowers the operability of mounting the terminals 605 to the inner housing 609.

SUMMARY

The presently disclosed subject matter may provide a shielded connector enabling a terminal to be easily inserted even when a length of a sheath of a shielded electric wire to be stripped is short.

The shielded connector may comprise: an inner housing including a plurality of terminal accommodation chambers into which terminals crimped to a plurality of shielded-wire ends of a shielded electric wire are inserted; and a shield shell including a shield part which covers the inner housing and a barrel part which crimps and fixes a sheath part of the shielded electric wire, wherein each of the terminal accommodation chambers has a space that is opened in a first direction at one side thereof and that is opened in a second direction orthogonal to the first direction at front and rear sides thereof, and a partition wall partitioning the space includes: an engaging part that restrains one of the terminals, which is inserted into the space from the one side, from moving in the second direction; and a temporary engaging part that prevents the one of the terminals, which is inserted into the space from the one side, from separating from the space.

The temporary engaging part may be configured by a flexible arm that is engaged with an engaging protrusion protruding from the one of the terminals.

The one of the terminals may be a male terminal.

The one side of the space may be closed by a front holder including a terminal through-hole through which a leading end of the male terminal passes.

The presently disclosed subject matter has been briefly described. The detailed configurations of the presently disclosed subject matter will be more clearly understood by reading through an illustrative embodiment for implementing the presently disclosed subject matter with reference to the accompanying drawings.

DETAILED DESCRIPTION OF EXEMPLARY EMBODIMENTS

Hereinafter, an illustrative embodiment of the presently disclosed subject matter will be described with reference to the drawings.

A shielded connector 11 of the illustrative embodiment can be appropriately used as a shielded connector of a cable-side of a USB 2.0 (differential connector for high-speed transmission).

Figure 1:
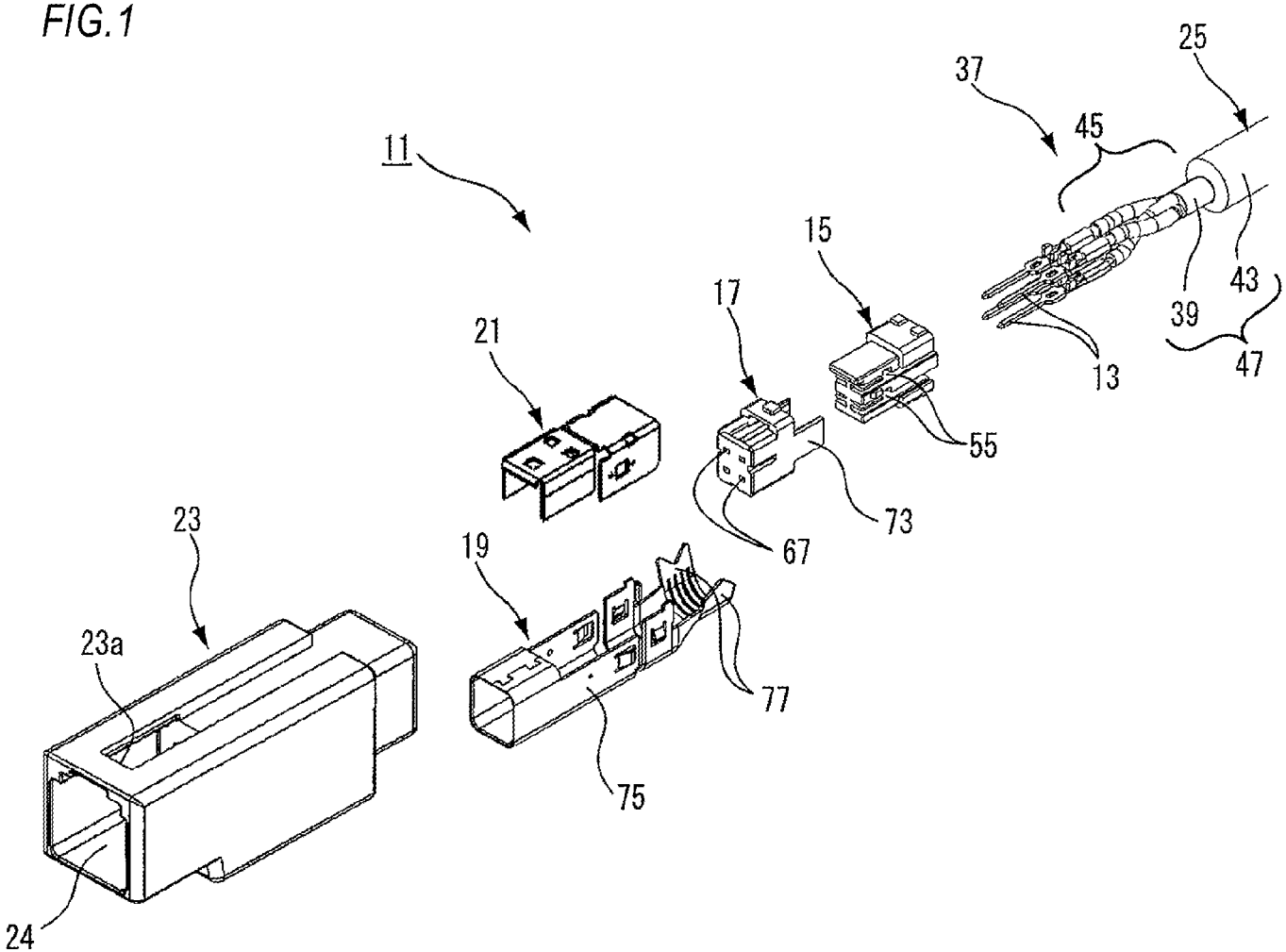
FIG. 1 is an exploded perspective view of a shielded connector according to an illustrative embodiment of the presently disclosed subject matter.

As shown in FIG. 1, the shielded connector 11 includes male terminals 13 that are terminals, an inner housing 15, a front holder 17, a shield shell 19, a shield shell cover 21, and an outer housing 23. Also, in the specification, the front side of the outer housing 23 (a left-lower side of FIG. 1) is referred to as the front side, and the rear side of a shielded electric wire 25 (a right-upper side of FIG. 1) is referred to as the rear side.

Figure 2:
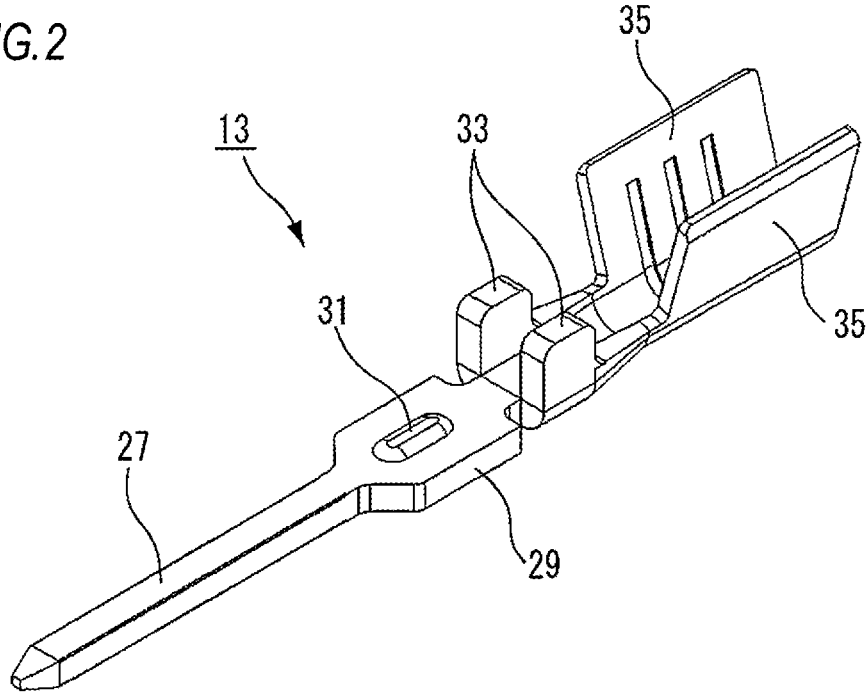
FIG. 2 is an enlarged view of a terminal shown in FIG. 1.

The male terminal 13 is made by sheet metal working and includes a tap-shaped electric contact part 27, as shown in FIG. 2. A contact base end portion 29 of the electric contact part 27 is formed with an indent 31 that is an engaging protrusion and that is formed to protrude by an extrusion molding and the like. At the rear side of the contact base end portion 29, a pair of front-rear moving control pieces 33 is provided to stand up. At the rear side of the front-rear moving control pieces 33, a pair of conductor crimping pieces 35 for crimping an inner conductor of the shielded electric wire 25 is provided to stand up. The male terminal 13 is connected to the shielded electric wire 25 to thereby form a terminal-mounted shielded electric wire 37.

The shielded electric wire 25 includes a plurality of (four, in this illustrative embodiment) inner conductors that are covered by inner protective coverings. In the specification, the inner conductor and the inner protective covering that covers the inner conductor are referred to as a shielded wire 41. The plurality of shielded wires 41 are further covered by a shield foil 39, which is an outer protective covering, and a sheath part 43, thereby forming the shielded electric wire 25. In the shielded electric wire 25, a sheath 47 comprised of at least the sheath part 43 and the shield foil 39 is required to be stripped at a connection part 45 to be connected to the male terminal 13. The part whose sheath 47 is stripped causes an impedance mismatch to thus deteriorate transmission performance. Hence, a length of the sheath 47 of the connection part 45 which is stripped is preferable as short as possible.

Figure 4:
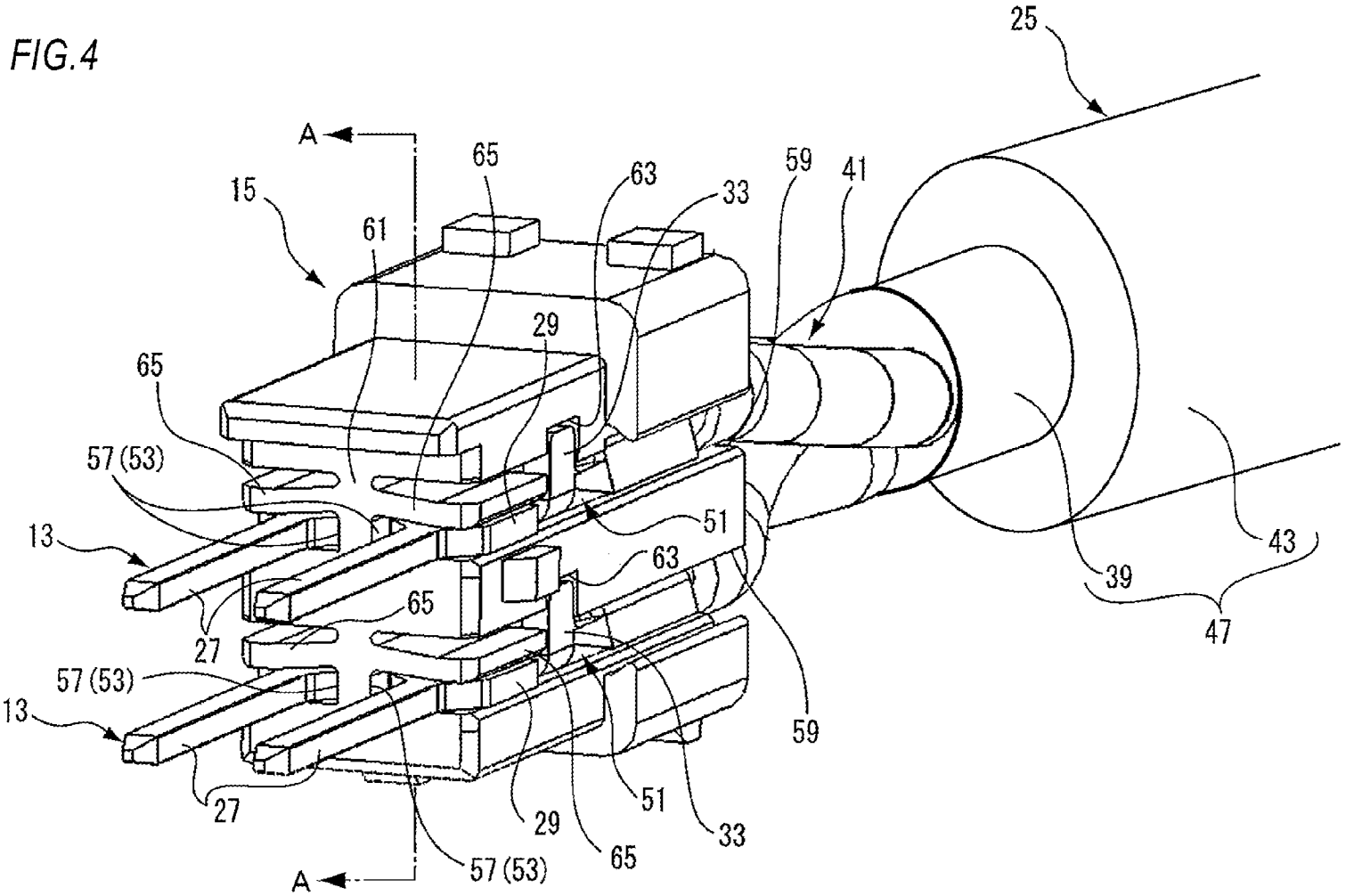
FIG. 4 is a perspective view of an inner housing having terminals mounted thereto.
Figure 5:
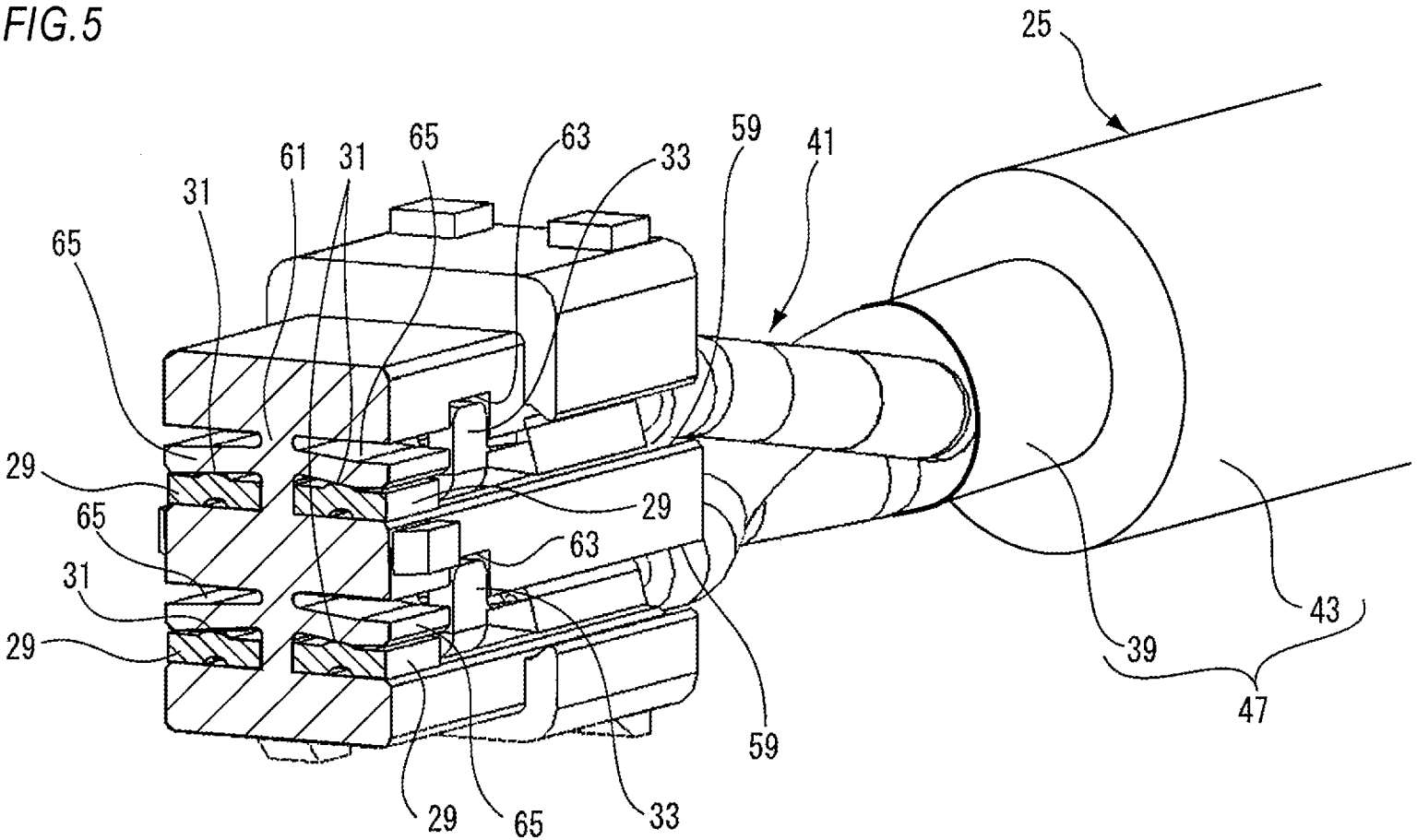
FIG. 5 is a perspective view of the inner housing shown in FIG. 4, which is cut along an A-A direction.

The inner housing 15 is formed of a synthetic resin material and includes a plurality of terminal accommodation chambers 51 (refer to FIG. 4) into which the male terminals 13 crimped to a plurality of shielded-wire ends 49 of the shielded electric wire 25 are inserted. The terminal accommodation chamber 51 has a space 53 that is opened in one side, front and rear directions. The space 53 is opened in the one side direction (first direction), which is orthogonal to the front-rear direction (second direction), at the one side thereof to form a terminal insertion opening 55 (refer to FIG. 7). Also, the space 53 is opened in the front direction (second direction) at the front side thereof to form an electric contact part insertion hole 57 on a front surface of the inner housing 15. The space 53 is opened in the rear direction (second direction) at the rear side thereof to form a shielded wire extraction opening 59 on a rear surface of the inner housing 15.

A partition wall 61 partitioning the space 53 of the terminal accommodation chamber 51 includes a recess-shaped engaging part 63 that restrains the male terminal 13, which is inserted into the space 53 from the one side, from moving in the front-rear direction, and a temporary engaging part that prevents the terminal, which is inserted from the one side, from separating from the terminal insertion opening 55. In the illustrative embodiment, the temporary engaging part is configured by a flexible arm 65 that is engaged with the indent 31 protruding from the male terminal 13. A surface of the flexible arm 65, which faces the terminal, is formed with a minute convex portion (bent portion), which makes it more difficult for the indent 31 to be separated, at an outer side than the indent 31. Instead of the minute convex portion, a minute recess portion that is fitted with the indent 31 may be formed.

The front holder 17 shown in FIG. 1 includes a front face plate and is inserted into a front side part of the inner housing 15. The front face plate is formed with a plurality of (four, in this illustrative embodiment) terminal through-holes 67 that coincides with the electric contact part insertion holes 57 of the inner housing 15. The front face plate is formed with a pair of holder side plates 73 extending rearward. The front holder 17 is mounted, so that the terminal insertion openings 55 of the one side of the inner housing 15 are closed by the holder side plates 73.

The shield shell 19 shown in FIG. 1 is formed by sheet metal working with a sheet metal material. The shield shell 19 includes a box-shaped shield part 75 that covers the inner housing 15 inserted therein. A barrel part 77, which crimps and fixes the sheath part 43 of the shielded electric wire 25, extends from the rear side of the shield part 75. The inner housing 15 into which the male terminals 13 of the terminal-mounted shielded electric wires 37 are inserted is inserted into the shield shell 19, so that the sheath part 43 of the terminal-mounted shielded electric wires 37 is crimped to the barrel part 77.

The shield shell cover 21 is mounted so that it covers an upper opening of the shield shell 19 from the above. Engaging holes formed on both sides of the shield shell cover 21 are engaged with engaging claws formed on both sides of the shield part 75, so that the shield shell cover 21 is fixed to the shield part 75.

The outer housing 23 is formed into an angled cylinder shape with a synthetic resin material. The outer housing 23 has a shell mounting space 24 formed therein. The inner housing 15, which is covered by the shield shell 19, is inserted and held in the shell mounting space 24. A mating connector 81 that will be described later is connector-fitted at the front side of the shell mounting space 24.

Figure 3A:
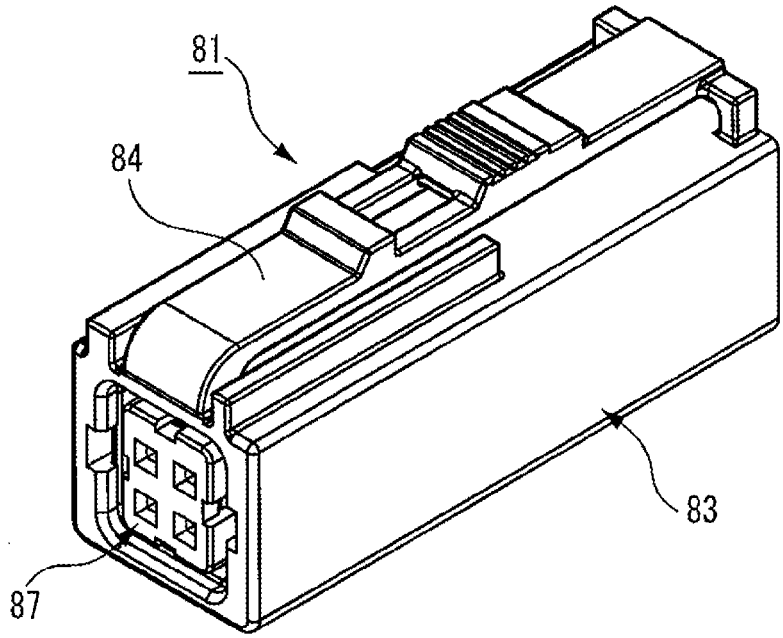
FIG. 3(*a*) is a perspective view of a mating connector and FIG. 3(*b*) is a longitudinal sectional view of the mating connector shown in FIG. 3(*a*).
Figure 3B:
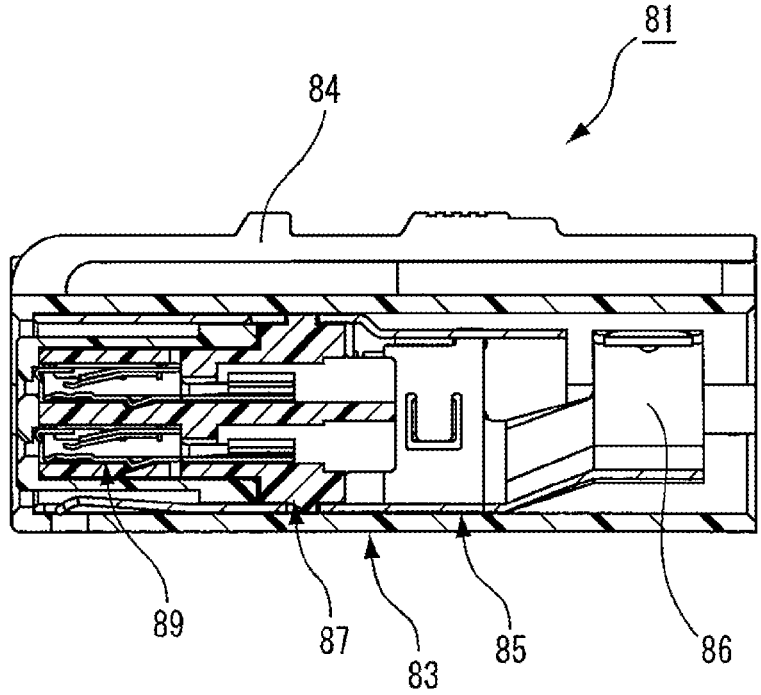

As shown in FIG. 3(*a*) and FIG. 3(*b*), the mating connector 81 includes an inner housing 87, an outer shield shell 85 that covers an outer side of the inner housing 87, and an outer housing 83.

Each of female terminals 89 that are connected to shielded wires of a shielded electric wire (not shown) includes a box-shaped electric contact part and contacts the tap-shaped electric contact part 27 of the male terminal 13 shown in FIG. 2.

When the shielded connector 11 is connector-fitted, the inner housing 87 that accommodates therein the female terminals 89 is covered by the shield part 75 of the shield shell 19. The outer shield shell 85 is provided with a barrel part 86 to upright stand, which is crimped and fixed to the sheath part 43 of the shielded electric wire 25.

One side surface (upper surface in FIG. 3(*a*) and FIG. 3(*b*)) of the outer housing 83 that accommodates therein the outer shield shell 85 and the inner housing 87 is provided with a lock arm 84 that is locked in a lock hole 23*a* of the outer housing 23 of the shielded connector 11.

Subsequently, a sequence of assembling the shielded connector 11 is described.

Figure 6:
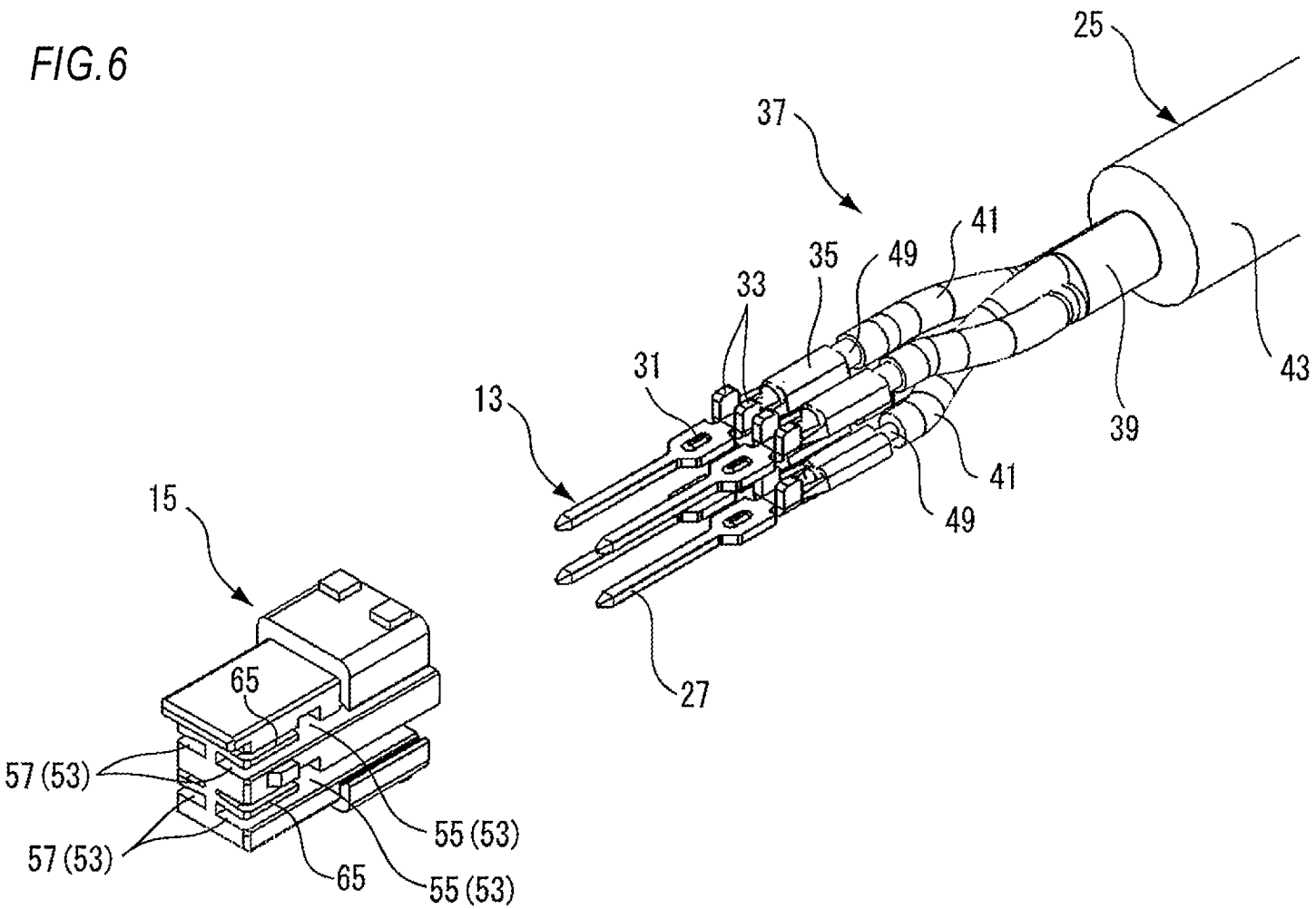
FIG. 6 is an enlarged view of the inner housing and terminal-mounted shielded electric wires shown in FIG. 1.
Figure 7:
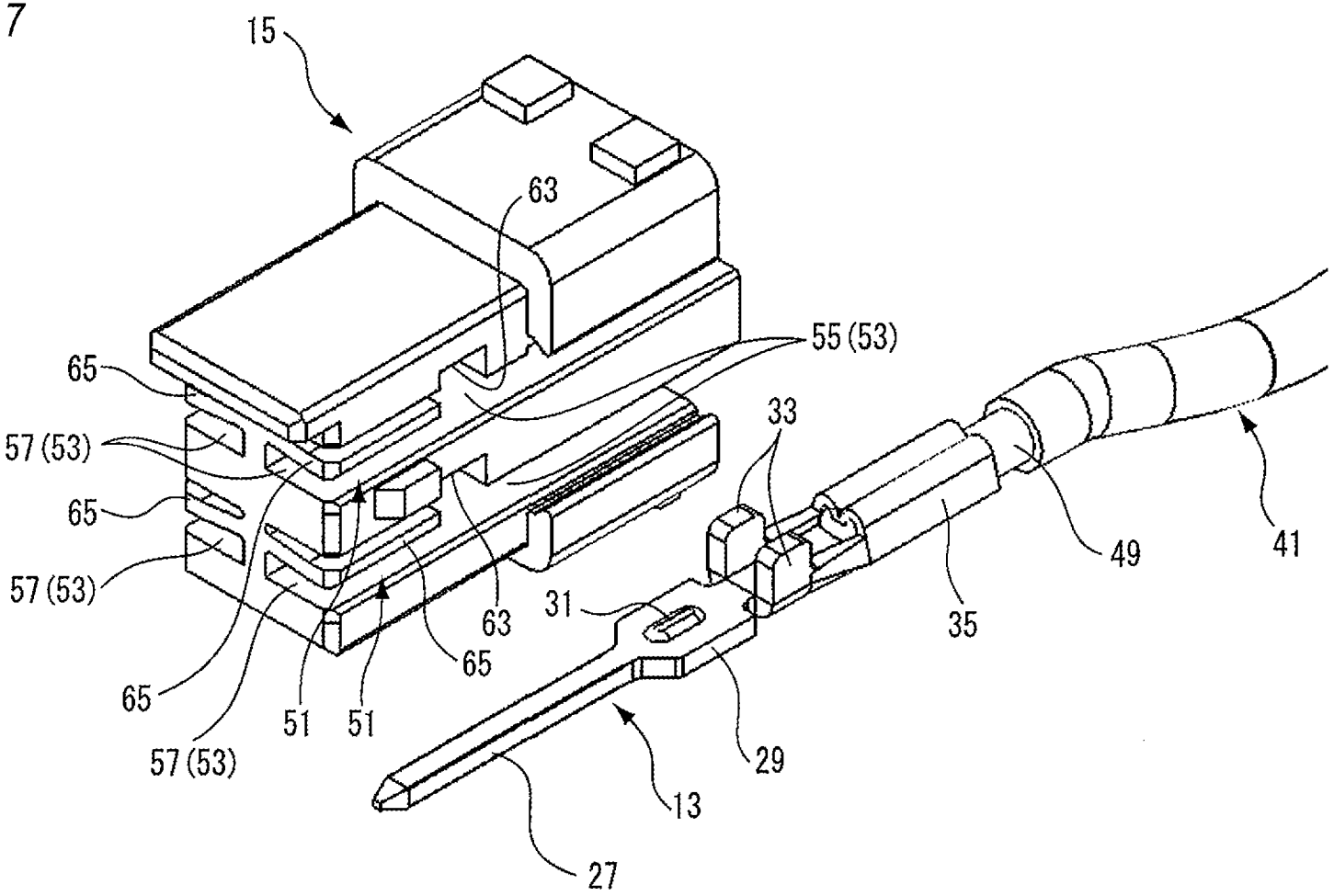
FIG. 7 is a perspective view of the inner housing just before the terminal is mounted to a terminal accommodation chamber.

As shown in FIG. 6, in order to assemble the shielded connector 11, the male terminals 13 are crimped to the plurality of shielded-wire ends 49 of the shielded electric wire 25 to thus configure the terminal-mounted shielded electric wires 37. Then, as shown in FIG. 7, each of the male terminals 13 of the terminal-mounted shielded electric wires 37 is arranged at one side of the corresponding terminal accommodation chamber 51, and is then parallel shifted to be inserted from the terminal insertion opening 55.

Figure 8:
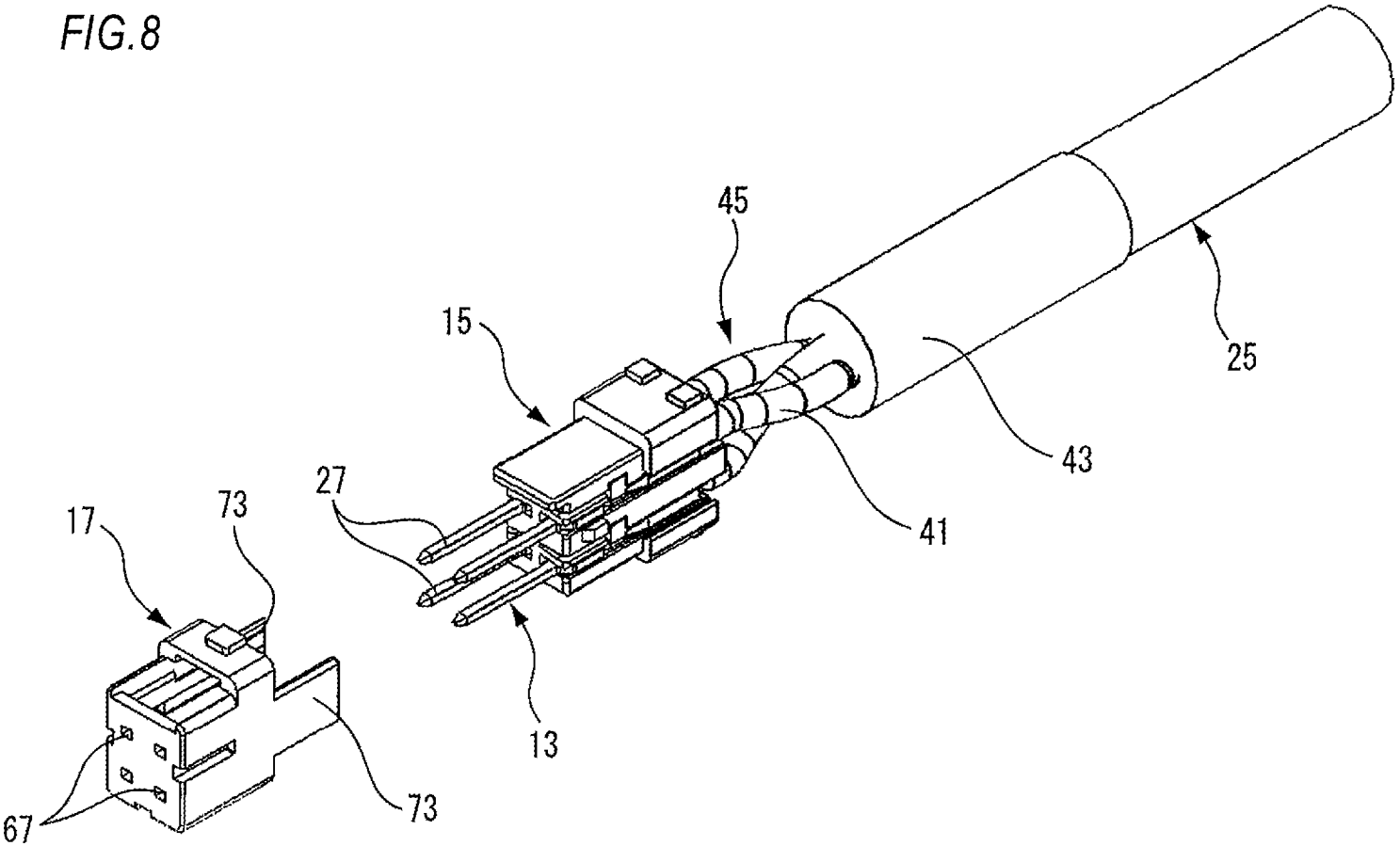
FIG. 8 is a perspective view before a front holder is mounted to the inner housing.
Figure 9:
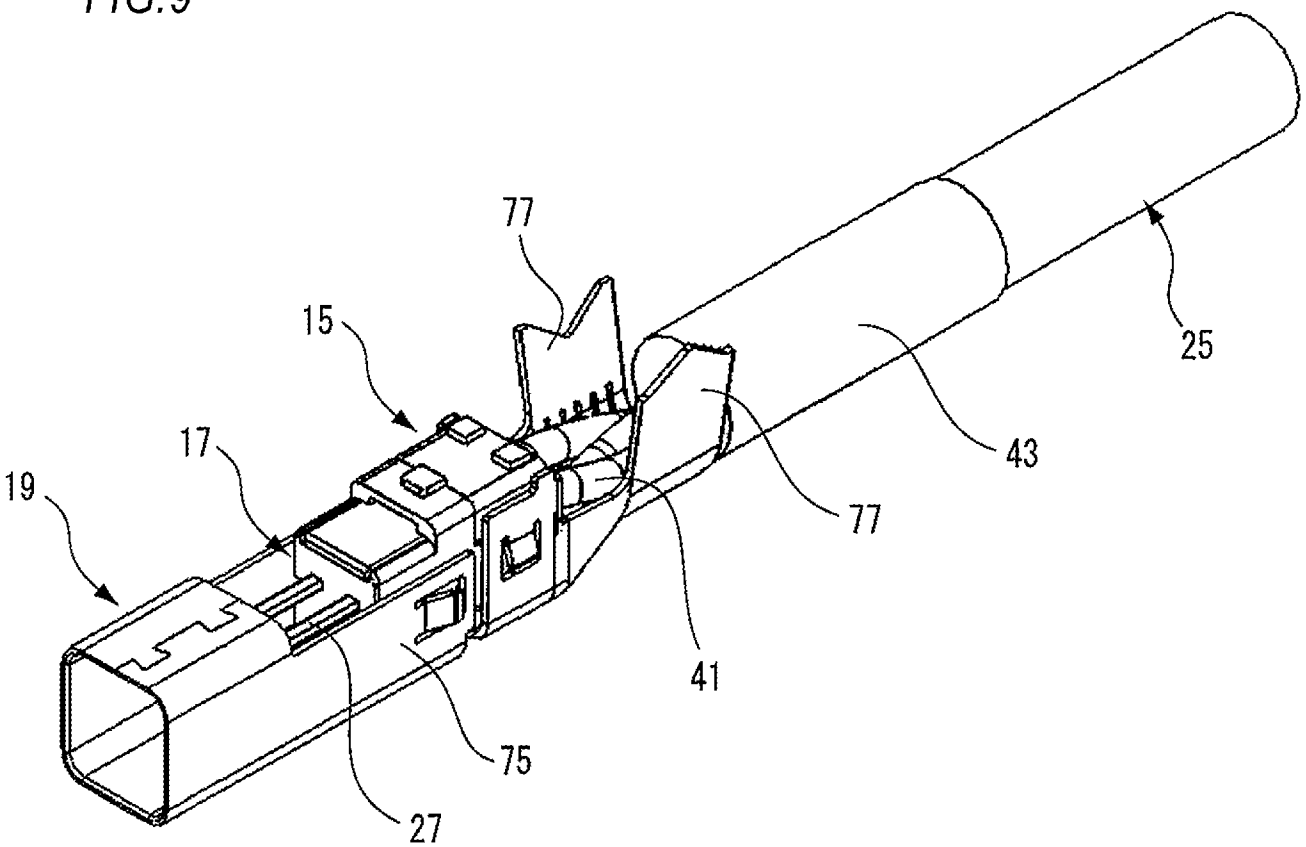
FIG. 9 is a perspective view of a shield shell while the inner housing is being incorporated.
Figure 10:
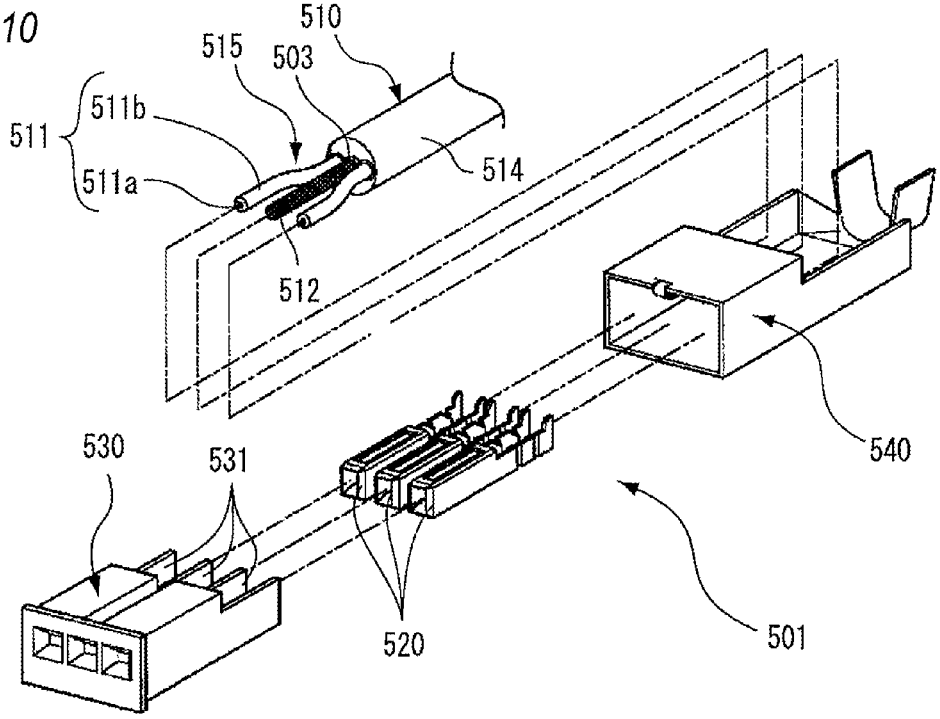
FIG. 10 is an exploded perspective view of a shielded connector of the related art.
Figure 11:
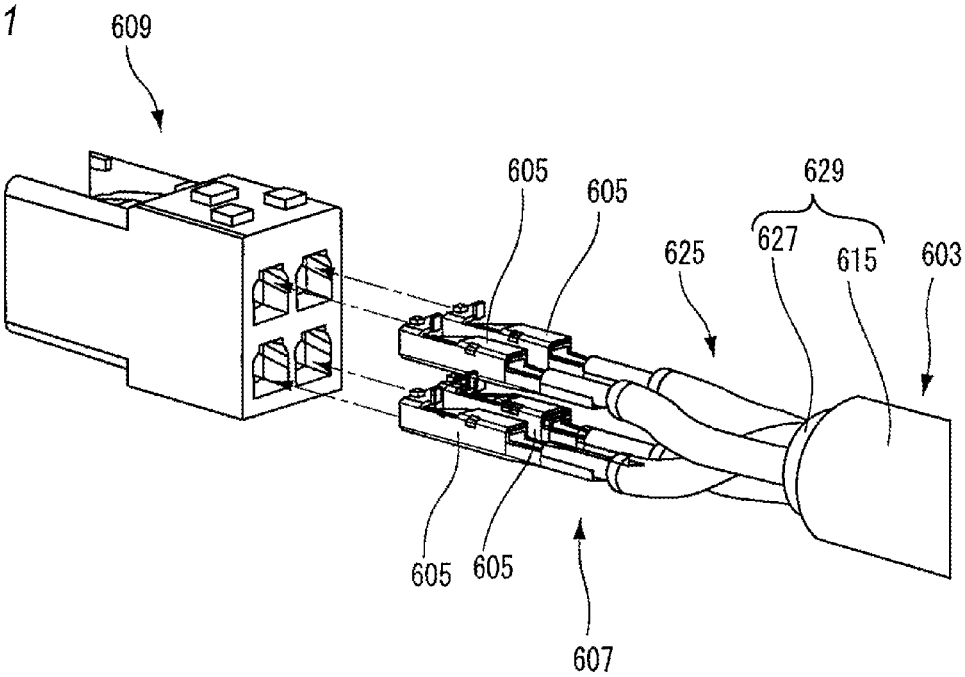
FIG. 11 is an exploded perspective view of main parts for illustrating a problem of the shielded connector of the related art.

Then, as shown in FIG. 8, the front holder 17 is mounted from the front side of the inner housing 15. Then, the inner housing 15 incorporating the front holder 17 is mounted to the shield part 75 of the shield shell 19, as shown in FIG. 9. The sheath part 43 of the terminal-mounted shielded electric wires 37 to which the inner housing 15 is attached is crimped and fixed with the barrel part 77 of the shield shell 19. The upper opening of the shield shell 19 is covered by mounting the shield shell cover 21 on the shield shall 19. At last, the shield shell 19 is inserted into the outer housing 23.

In the below, the operations of the shielded connector 11 having the above configuration are described.

In the shielded connector 11 of the illustrative embodiment, the terminal accommodation chamber 51 is opened at the one side of the inner housing 15 in the one side direction which is orthogonal to the front direction and the rear direction of the terminal accommodation chambers 51. The shielded-wire ends 49 are respectively provided with the male terminals 13. The shielded electric wire 25 is formed with the connection part 45 between the shielded wire 25 and the male terminals 13. In the connection part 45, the sheath 47 that binds together the plurality of shielded wires 41 is stripped, so that a restraint state by the sheath 47 is released, and the male terminals 13 can be thus separated from each other. In the connection part 45, the sheath 37 is stripped within a short length range so that an impedance mismatch to deteriorate the transmission performance is not caused. When mounting the male terminals 13 to the terminal accommodation chambers 51, each of the male terminals 13 is parallel arranged at one side of the corresponding terminal accommodation chamber 51 with the connection part 45 being bent.

In the shielded connector 11 of the illustrative embodiment, the male terminals 13 of the terminal-mounted shielded electric wires 37, which have been inserted at one time in the related art, can be inserted one by one. That is, the male terminal 13 can be easily inserted just by parallel shifting it from one side of the terminal accommodation chamber 51 even when the connection part 45 is short. Thereby, the simultaneous insertion operation or alignment operation of the semi-insertion state of the male terminals 13 is not necessary.

Also, while the plurality of male terminals 13 are sequentially inserted into the terminal accommodation chambers 51, the inserted male terminal 13 is restrained from being separated from the terminal accommodation chamber 51 by the flexible arm 65, so that the operability is improved. The terminal insertion opening 55 is closed by the shield part 75 of the shield shell 19, so that the male terminal 13 is not separated therefrom. Hence, it is possible to form the flexible arm 65 by the simple structure formed at the partition wall 61 of the terminal accommodation chamber 51.

Also, in the shielded connector 11 of the illustrative embodiment, the terminal accommodation chamber 51 that is opened with the terminal insertion opening 55 at the one side of the inner housing 15 is provided with the flexible arm 65 that is engaged with the indent 31 protruding from the male terminal 13, that is formed to protrude toward the one side and that can be thus bent in the direction of holding the male terminal 13 vertically. The male terminal 13 is formed with the protruding indent 31 on the surface facing the flexible arm 65. Thus, the male terminal 13 that is inserted into the terminal accommodation chamber 51 with widening the flexible arm 65 is engaged with the flexible arm 65 to which the indent 31 is pressed by the elastic restoring force, and is thus restrained from being easily separated from the terminal insertion opening 55. Therefore, since the male terminal 13 is temporarily engaged by the flexible arm 65 upon the terminal insertion operation, it is possible to easily perform the insertion/separation operation, so that the operability is improved.

Also, in the shielded connector 11 of the illustrative embodiment, the terminal is the male terminal 13, so that the electric contact part of the terminal leading end part is generally formed to have a thickness narrower than the box-shaped female terminal. Hence, compared to the terminal accommodation chamber 51 having the same volume, the male terminal 13 has a smaller occupying area in the terminal accommodation chamber 51 than the female terminal. To that extent, it is possible to form the flexible arm 65 more easily, so that it is easy to obtain a flexible stroke of the flexible arm 65.

Also, in the shielded connector 11 of the illustrative embodiment, when the front holder 17 is mounted to the inner housing 15, the electric contact part 27 of the male terminal 13 that protrudes from the terminal accommodation chamber 51 penetrates the terminal through-hole 67 of the front holder 17. Thereby, the electric contact part 27 of the male terminal 13 is positioned with high precision and is held with high strength. Also, when the front holder 17 is mounted, the one side of the space 53 in the terminal accommodation chamber 51, which corresponds to the terminal insertion opening 55, is closed by the front holder 17. Thus, the terminal insertion opening 55 is securely closed by the dual structure of the front holder 17 and the shield part 75 covering the outer side thereof.

Thus, according to the shielded connector 11 of the illustrative embodiment, the male terminals 13 can be respectively inserted into the terminal accommodation chambers 51 from the one side thereof. Hence, even when the length of the sheath 47 of the shielded electric wire 25 that is stripped is short, it is possible to easily insert the male terminals 13.

Also, the shielded connector of the presently disclosed subject matter is not limited to the above illustrative embodiment and can be appropriately modified and improved. The materials, shapes, sizes, the number, arrangement positions and the like of the respective constitutional elements in the illustrative embodiment are arbitrary and are not particularly limited insomuch as they can achieve the presently disclosed subject matter.

According to an aspect of the presently disclosed subject matter, the terminal accommodation chamber is opened at one side of the inner housing in a direction orthogonal to a front-rear direction of the terminal accommodation chamber. The shielded-wire ends are respectively provided with the terminals. The shielded electric wire is formed with a connection part between the shielded wire and the terminals. In the connection part, a sheath that binds together the plurality of shielded wires is stripped, so that a restraint state by the sheath is released and the terminals can be separated from each other. In the connection part, the sheath is stripped within a short length range so that an impedance mismatch to deteriorate the transmission performance is not caused. When mounting the terminals to the terminal accommodation chambers, each of the terminals is parallel arranged at one side of the corresponding terminal accommodation chamber 51 with the connection part 45 being bent.

Also, while the plurality of terminals is sequentially inserted into the terminal accommodation chambers, the inserted terminals are restrained from being separated from the terminal accommodation chambers by the temporary engaging parts, so that the operability is improved. A terminal insertion opening that is opened at the one side of the space in the terminal accommodation chamber is closed by the shield part of the shield shell, so that the terminal is not separated from the terminal accommodation chamber. Hence, it is possible to form the temporary engaging part by the simple structure formed at the partition wall of the terminal accommodation chamber.

According to an aspect of the presently disclosed subject matter, the terminal accommodation chamber that is opened with the terminal insertion opening at the one side of the inner housing is provided with the flexible arm that is engaged with the engaging protrusion protruding from the terminal, is formed to protrude toward the one side and can be thus bent in the direction of holding the terminal vertically. The terminal is formed with the protruding engaging protrusion on a surface facing the flexible arm. Thus, the terminal that is inserted into the terminal accommodation chamber with widening the flexible arm is engaged with the flexible arm to which the engaging protrusion is pressed by an elastic restoring force and is thus restrained from being easily separated from the terminal insertion opening. Therefore, since the terminal is temporarily engaged by the flexible arm upon the terminal insertion operation, it is possible to easily perform the insertion/separation operation, so that the operability is improved.

According to an aspect of the presently disclosed subject matter, the terminal is the male terminal, so that a terminal leading end part (electric contact part) is generally formed to have a thickness narrower than a box-shaped female terminal. Hence, compared to the terminal accommodation chamber having the same volume, the male terminal has a smaller occupying area in the terminal accommodation chamber than the female terminal. To that extent, it is possible to form the flexible arm more easily, so that it is easy to obtain a flexible stroke of the flexible arm.

According to an aspect of the presently disclosed subject matter, when the front holder is mounted to the inner housing, the leading end of the male terminal that protrudes from the terminal accommodation chamber penetrates the terminal through-hole of the front holder. Thereby, the leading end of the male terminal is positioned with high precision and is held with high strength. Also, when the front holder is mounted to the inner housing, the one side of the space in the terminal accommodation chamber, which corresponds to the terminal insertion opening, is closed by the front holder. Thus, the terminal insertion opening is securely closed by a dual structure of the front holder and the shield part covering an outer side thereof.

According to an aspect of the presently disclosed subject matter, the terminals can be respectively inserted into the terminal accommodation chambers from the one side thereof. Hence, even when the length of the shielded electric wire that is stripped is short, it is possible to easily insert the terminals 13.

What is claimed is:

1. A shielded connector comprising:

an inner housing including a plurality of terminal accommodation chambers into which terminals crimped to a plurality of shielded-wire ends of a shielded electric wire are inserted; and a shield shell including a shield part which covers the inner housing and a barrel part which crimps and fixes a sheath part of the shielded electric wire, wherein each of the terminal accommodation chambers has a space that is opened in a first direction at one side thereof and that is opened in a second direction orthogonal to the first direction at front and rear sides thereof, and a partition wall partitioning the space includes: an engaging part that restrains one of the terminals, which is inserted into the space from the one side, from moving in the second direction; and a temporary engaging part that prevents the one of the terminals, which is inserted into the space from the one side, from separating from the space.

2. The shielded connector according to claim 1, wherein the temporary engaging part is configured by a flexible arm that is engaged with an engaging protrusion protruding from the one of the terminals.

3. The shielded connector according to claim 1, wherein the one of the terminals is a male terminal.

4. The shielded connector according to claim 3, wherein the one side of the space is closed by a front holder including a terminal through-hole through which a leading end of the male terminal passes.

* * * * *